US005628352A

United States Patent [19]

Gracyalny et al.

[11] Patent Number: 5,628,352

[45] Date of Patent: May 13, 1997

[54] CLOSABLE POUR SPOUT FOR FLUID DISPENSING CONTAINER

[75] Inventors: Gary J. Gracyalny, Milwaukee; John H. Thiermann, Greenfield, both of Wis.

[73] Assignee: Briggs & Stratton Corporation, Wauwatosa, Wis.

[21] Appl. No.: 424,725

[22] Filed: Apr. 18, 1995

Related U.S. Application Data

[63] Continuation-in-part of Ser. No. 288,436, Aug. 10, 1994, Pat. No. 5,406,994, which is a continuation of Ser. No. 918,978, Jul. 24, 1992, abandoned.

[51] Int. Cl.[6] ..... B65B 1/04; B65B 3/04

[52] U.S. Cl. ..... 141/198; 141/293; 141/291; 141/352; 141/368; 222/189.1; 222/484

[58] Field of Search ..... 141/346, 352–354, 141/368, 286, 291–294, 192, 198, 301–307, 206, 351, 94; 222/198, 542, 566–571, 185, 181, 563, 481.5, 484, 506, 153.04, 153.14, 513, 514, 516, 189.07, 189.08, 189.1, 464, 478, 479, 523, 522, 465.1, 466, 468; 220/563, 367, 663, 662, 731, 745–747, 768, 86.2, 86.1, 771, 772

[56] References Cited

U.S. PATENT DOCUMENTS

| | | | |
|---|---|---|---|
| 3,078,883 | 2/1963 | Beall, Jr. | 141/198 |
| 3,207,190 | 9/1965 | Silbereis et al. | 141/198 |
| 3,289,712 | 12/1966 | Smith | 141/299 |
| 4,667,710 | 5/1987 | Wu | 141/198 |
| 4,834,151 | 5/1989 | Law | 141/198 |
| 4,924,921 | 5/1990 | Simmel et al. | 141/286 |
| 4,979,655 | 12/1990 | Gallucci | 141/332 |
| 5,076,333 | 12/1991 | Law | 141/198 |
| 5,125,440 | 6/1992 | Mette | 141/39 |
| 5,213,142 | 5/1993 | Koch et al. | 141/206 |
| 5,228,487 | 7/1993 | Thiermann et al. | 141/291 |
| 5,249,611 | 10/1993 | Law | 141/198 |

OTHER PUBLICATIONS

CarrySafe Safety Stop Flow, product package (no date available).

DSD PLASTICS Inc., product package (no date available).

*Primary Examiner*—Henry J. Recla
*Assistant Examiner*—Steven O. Douglas
*Attorney, Agent, or Firm*—Michael, Best & Friedrich

[57] ABSTRACT

A pour spout for conducting fluid from a container to a receptacle. The pour spout includes a conduit member having a first end interconnectable with the container and a second end having a discharge opening and a vent opening, and a closure member positioned adjacent to the discharge opening. The closure member is movable relative to the conduit member between a first position where the discharge and vent openings are closed, a second position where the vent opening is open, and a third position where the discharge opening is open. A closure locking device prevents bypassing the second position during movement of the closure member from the first position to the third position. A vent locking device prevents movement of the closure member from the first position to the second position when the container is tipped beyond a predetermined angle. Another device retains sub-ambient pressure within the container when closure member is in the second position.

53 Claims, 11 Drawing Sheets

FIG. 7
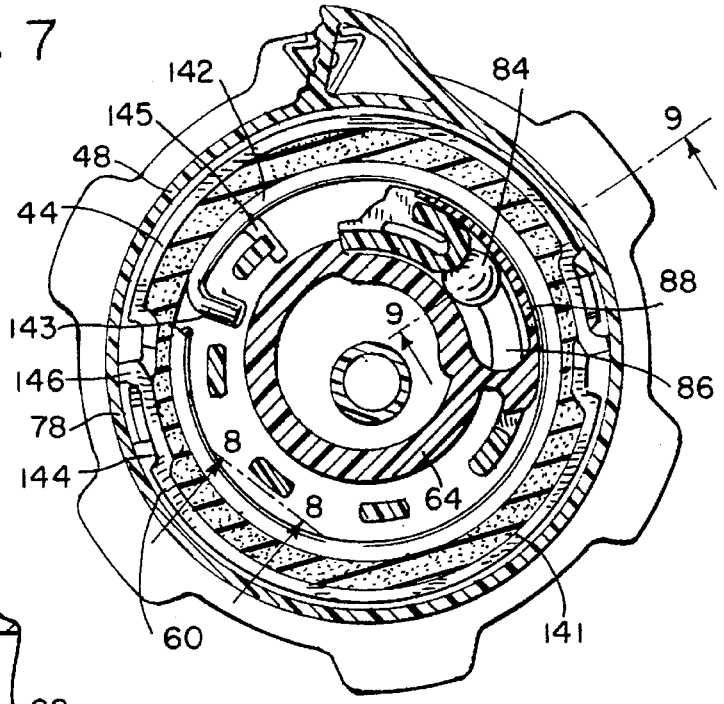
FIG. 8
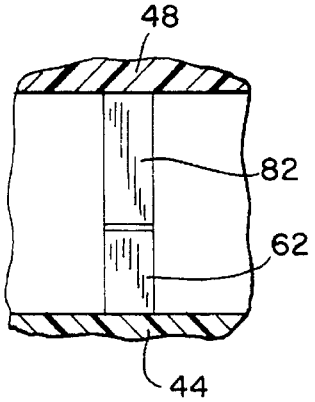
FIG. 9
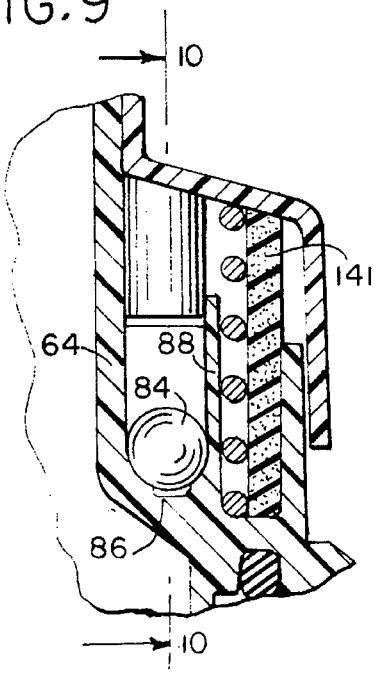
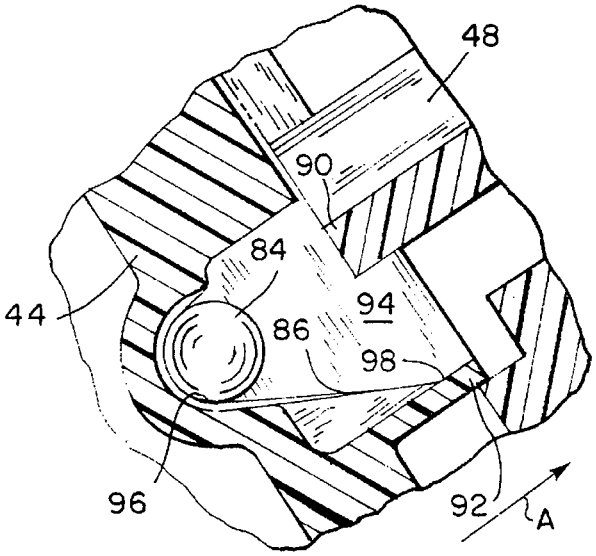
FIG. 10

FIG. 11
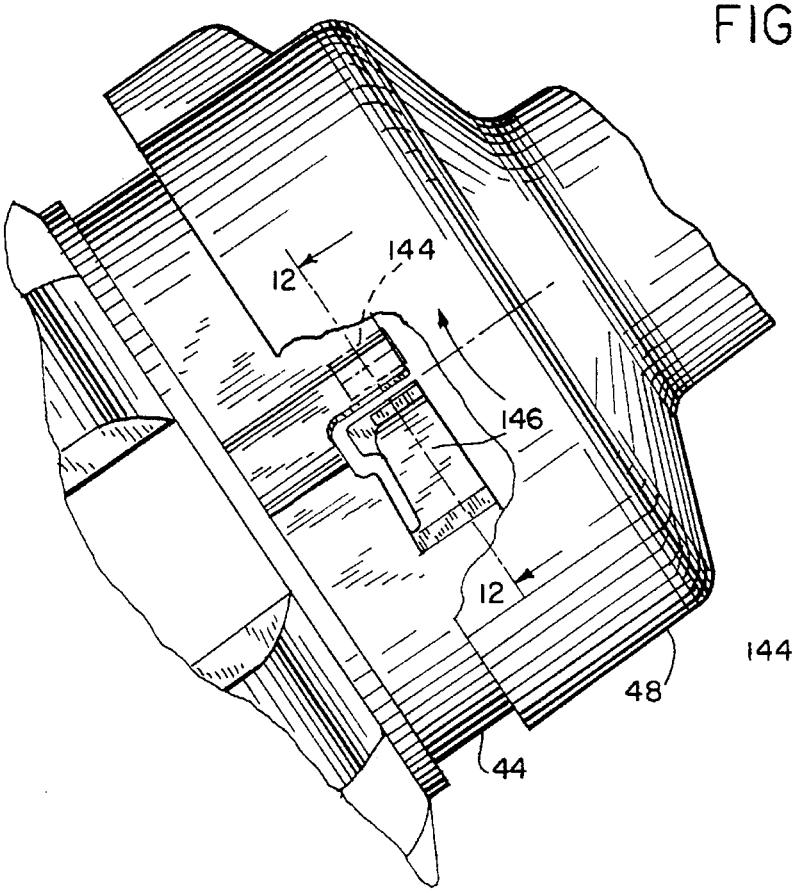
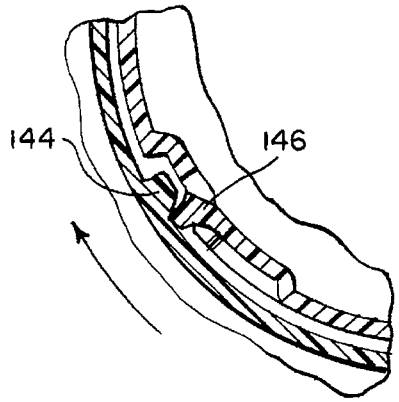
FIG. 12
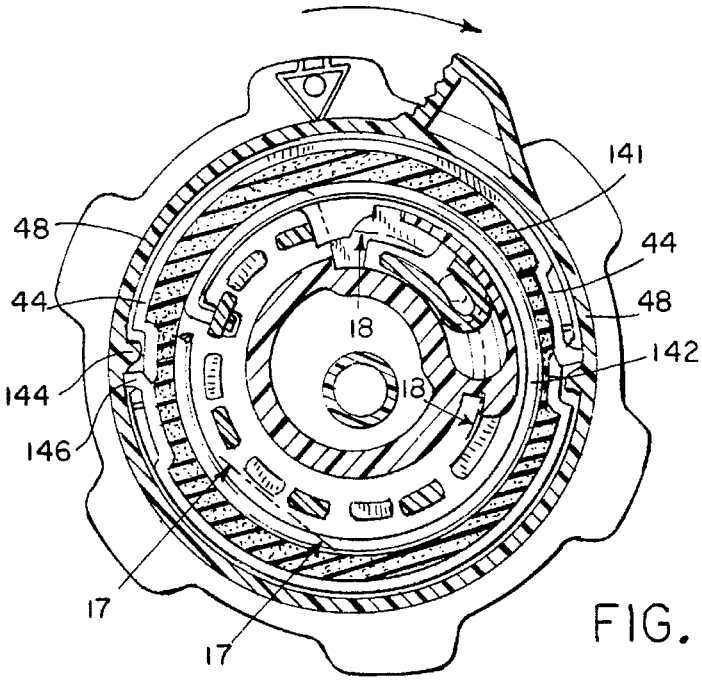
FIG. 16

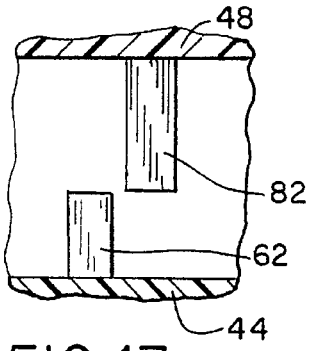
FIG. 17
FIG. 18
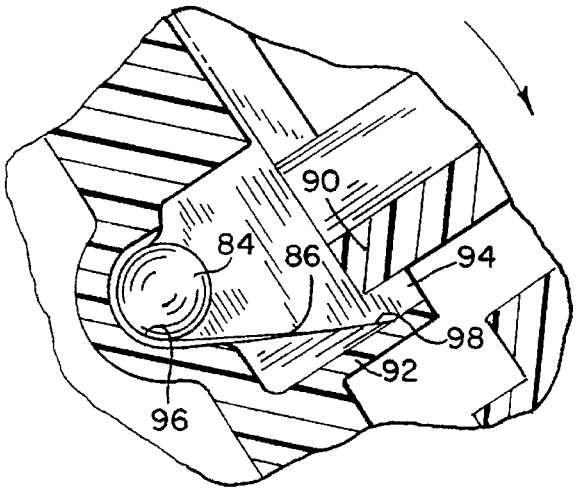
FIG. 19
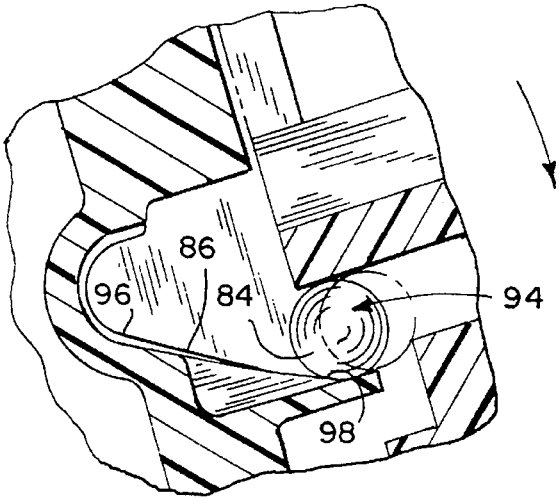
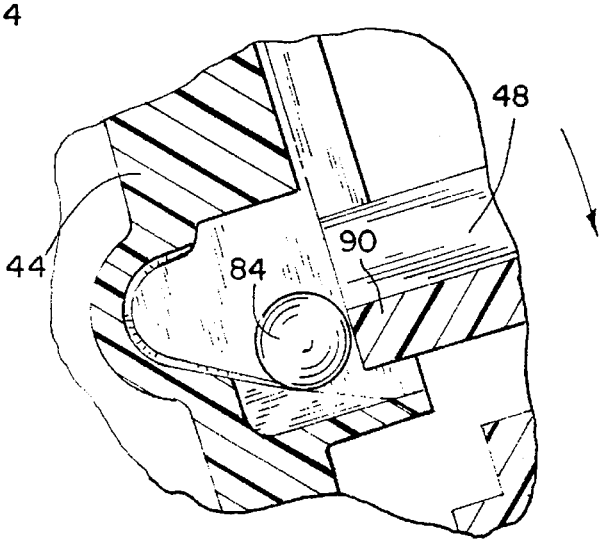
FIG. 21
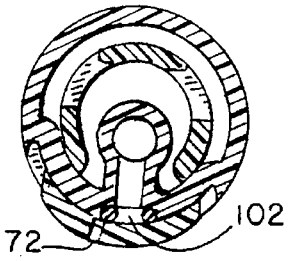
FIG. 20

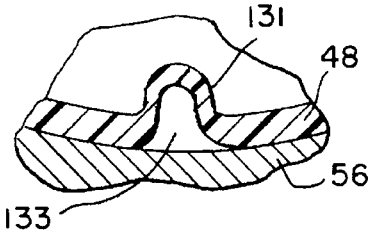
FIG. 26
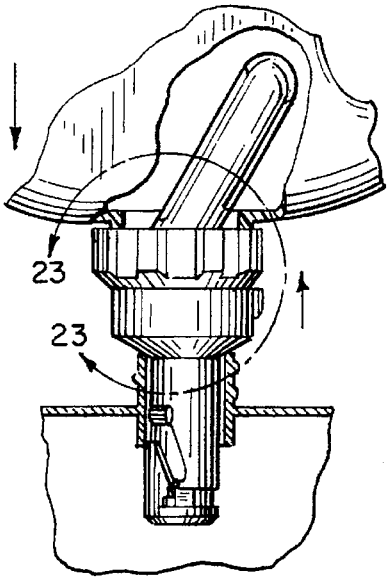
FIG. 22
FIG. 24
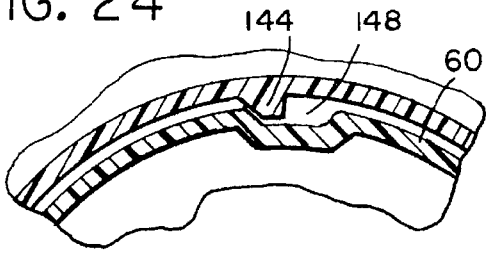
FIG. 23
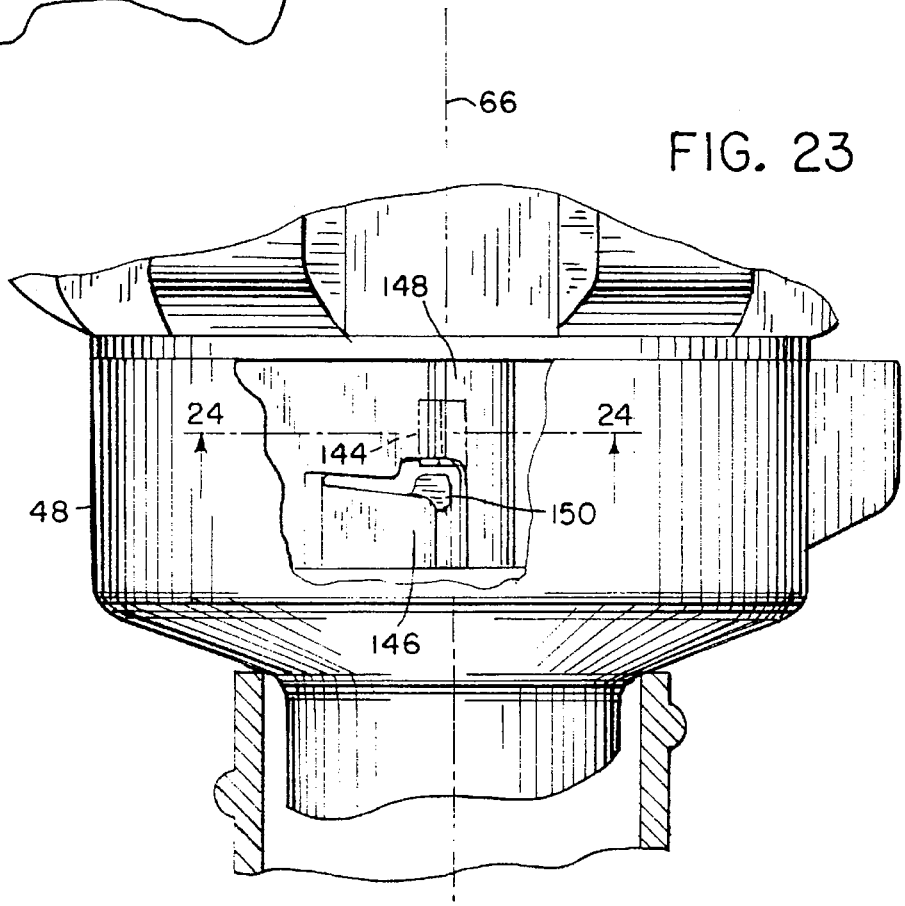

FIG. 30
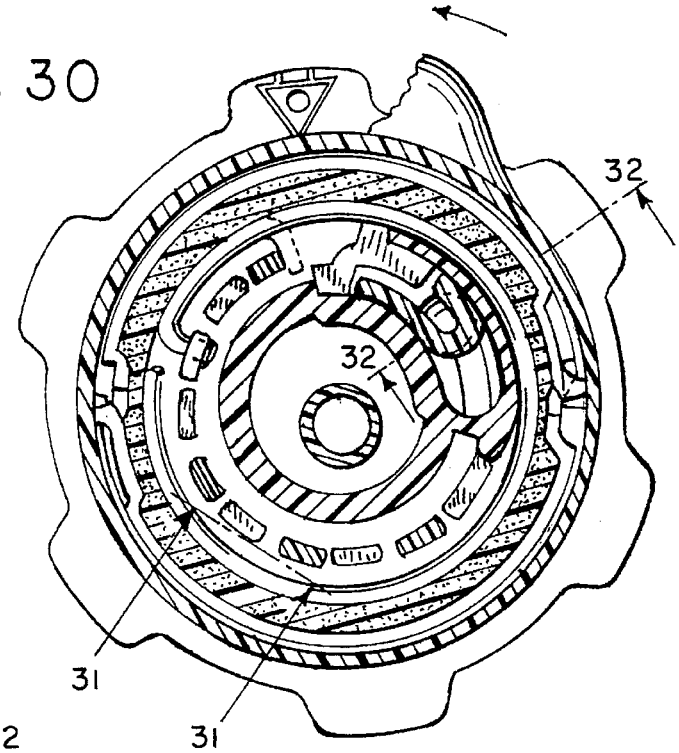
FIG. 31
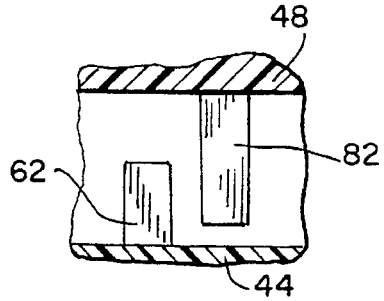
FIG. 32
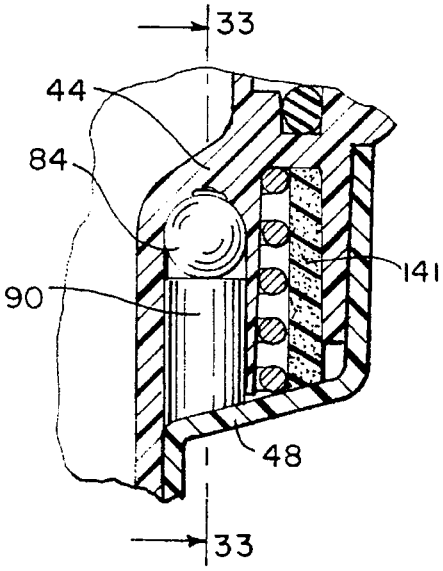
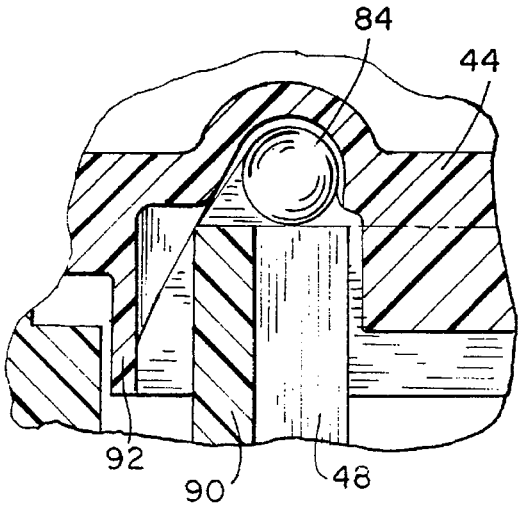
FIG. 33

FIG. 34
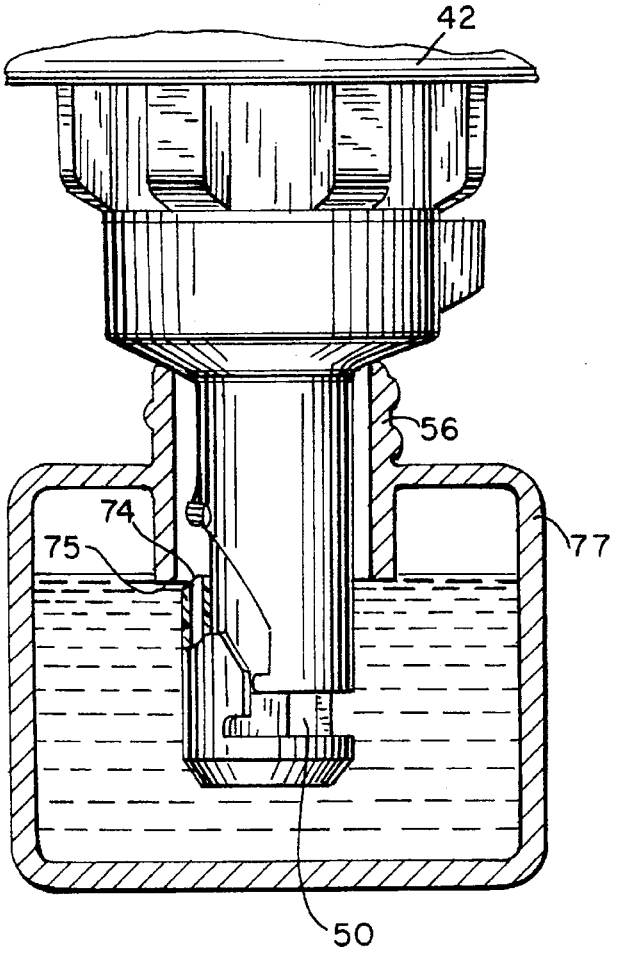
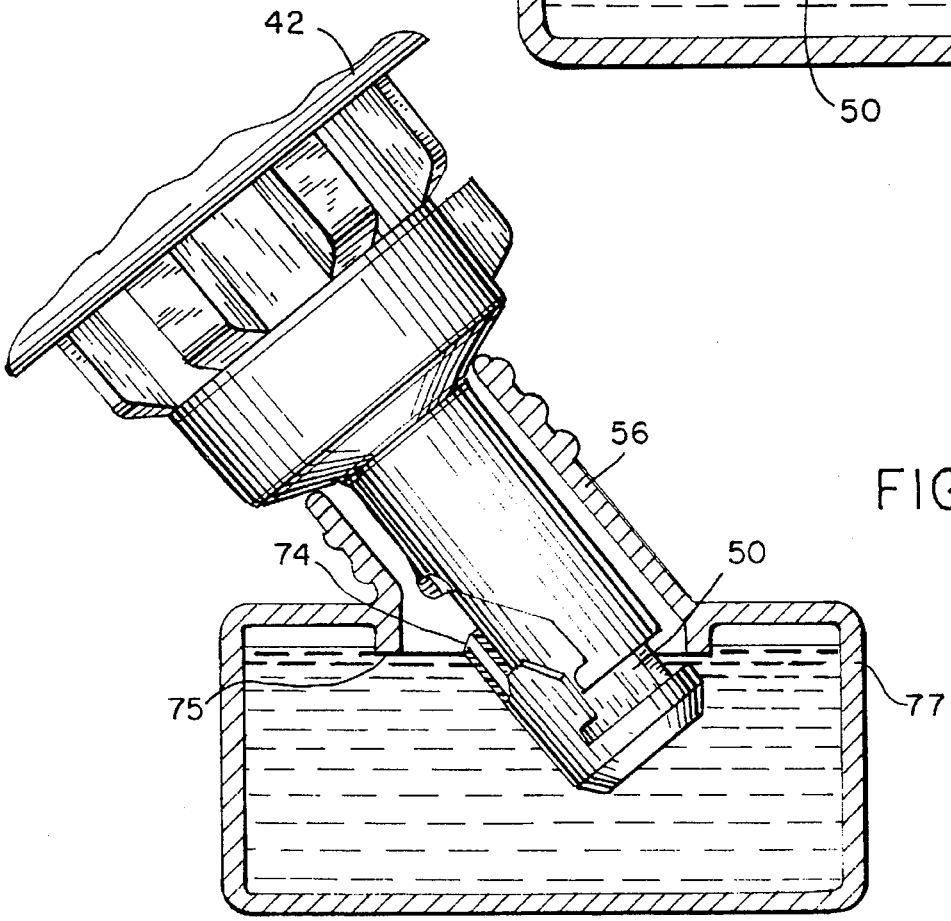
FIG. 35

FIG. 36
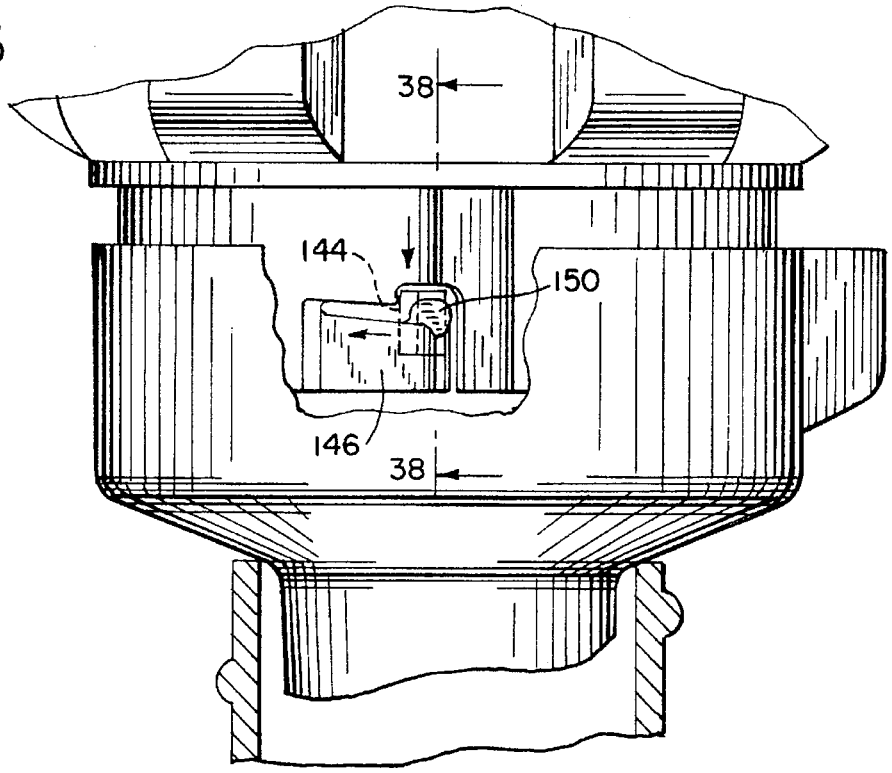
FIG. 37
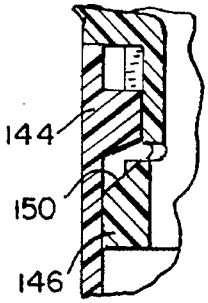
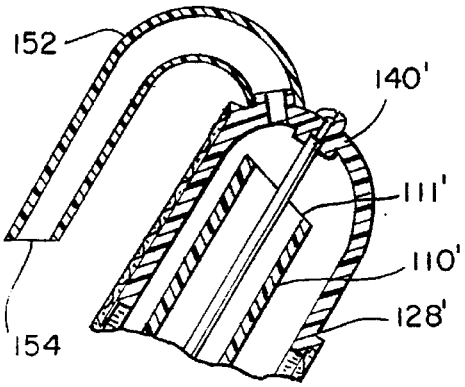
FIG. 39
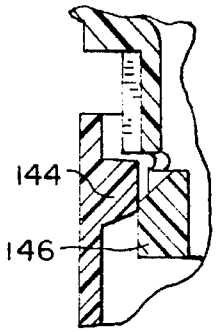
FIG. 38

CLOSABLE POUR SPOUT FOR FLUID DISPENSING CONTAINER

RELATED APPLICATIONS

The present application is a continuation-in-part of commonly-assigned U.S. patent application Ser. No. 08/288,436, filed Aug. 10, 1994, issued Apr. 18, 1995 as U.S. Pat. No. 5,406,994, which is a continuation of application Ser. No. 07/918,978, filed Jul. 24, 1992, now abandoned, which are incorporated herein by reference in their entirety.

FIELD OF THE INVENTION

The present invention generally relates to containers for storing and dispensing fluids. More particularly, the present invention relates to pour spouts which can be connected to such containers to facilitate discharge of fluids from the container.

BACKGROUND OF THE INVENTION

Fluid dispensing containers are utilized for storing fluid and for dispensing fluid to a receiving vessel. For example, fluid dispensing containers have been used for dispensing fuel to fuel tanks associated with small, internal-combustion engines, such as those used in lawnmowers, weed trimmers and other motorized devices.

Some fluid dispensing containers are specially designed to automatically cut off the flow of fluid from the container when the fluid in the receiving vessel reaches a predetermined level (i.e., an "auto-stop dispenser"). To accomplish this, the container is typically completely sealed except for a discharge port in a pour spout. When fluid is being dispensed from the container into a receiving vessel, the discharge port is positioned within the receiving vessel, and air entering the container must travel up through the discharge port. When the level of the fluid in the receiving vessel is high enough such that it covers the discharge port, the flow from the container will automatically stop since no more air can enter the container.

Some pour spout designs further include an air vent passageway within the pour spout for allowing air to enter the container without significantly affecting the flow of fluid through the discharge port. That is, air is allowed to enter the container in a smooth, controlled manner, thereby avoiding intermittent surging of the fluid. When utilizing an air vent in conjunction with an auto-stop design, fluid will continue to flow from the container until the fluid within the receiving vessel covers the inlet to the air vent.

In order to prevent fluid flow from the container when the pour spout is not properly positioned within the receiving vessel (e.g., before or after the pour spout is inserted into the receiving vessel), some pour spouts are provided with a biased closure device which covers and seals the discharge port when the pour spout is not completely inserted into a receiving vessel. For example, in one design, the pour spout can be pushed into the receiving vessel to force the closure member to its open position, thereby uncovering the discharge port.

To prevent fluid vapors (e.g., fuel vapors) from exiting the container during storage, many of the above-identified containers are designed to be completely sealed when not in use. Due to the volatile nature of the fluids which can be stored in such containers, the vapor pressure within the containers can rise significantly beyond atmospheric pressure, particularly when the container is stored for a long period of time and/or exposed to elevated temperatures. Because of the high pressure within the container, when a pour spout having a biased closure device is inserted into a receiving vessel and the closure device is opened, the fluid within the container has a tendency to spurt out at a rapid pace. This situation is undesirable in that it can result in splashing and spilling fluid and/or discharging more fluid than is desired, resulting in an overfilled receiving vessel.

In addition, since the above-described containers can be opened by merely axially moving the closure device, such containers can be susceptible to leaking, especially if the container tips over. For example, if the container is tipped onto its side, there is potential that the closure device may contact an object and be moved to its open position, thereby allowing fluid to exit the pour spout and spill onto surrounding objects.

SUMMARY OF THE INVENTION

Accordingly, it is a feature of the present invention to provide a fluid dispensing container that not only can be sealed when being stored, but also requires that the container be vented prior to discharging fluid from the container. It is a related feature of the present invention to require that the container be vented when the container is in a resting position (i.e., not tilted) and prior to discharge of fluid from the container.

It is another feature of the present invention to inhibit accidental opening of the container pour spout when the pour spout is in a sealed condition. Relatedly, any axial impact on the pour spout should be adequately distributed to inhibit the likelihood of failure of the pour spout.

The present invention includes a unique pour spout designed for conducting fluid from a container to a receptacle. In one aspect, the pour spout includes a conduit member including a first end interconnectable with the container and a second end having a discharge opening and a vent opening. A closure member is positioned adjacent to the discharge opening and is movable relative to the conduit member between a first position where the discharge and vent openings are closed, a second position where the vent opening is open, and a third position where the discharge opening is open.

In one embodiment, the pour spout includes a biasing member (e.g., a coil spring) for biasing the closure member from the second position to the first position. In this embodiment, it is advantageous to include a latch member for retaining the closure member in the second position. For example, the latch member may include a flexible member mounted to the conduit member, the flexible member being positioned to selectively engage a detail (e.g., a protruding boss) on the closure member. The biasing member can further bias the closure member from the third position to the first position. Preferably, however, movement of the closure member from the third position to the first position is free from retainment by the latch member.

In another embodiment, in addition to the vent opening, the conduit member further includes a gas inlet opening that allows gas to enter the container when fluid is being discharged from the container. The gas inlet opening could be spaced from a tip of the pour spout (e.g., by at least about 25 mm). The pour spout can further include a vent tube having an inner end and an outer end positionable in alignment with each of the vent opening and the gas inlet opening. The outer end of the vent tube is substantially sealed closed when the closure member is in the first position, is positioned in alignment with the vent opening when the closure member is in the second position, and is positioned in alignment with the gas inlet opening when the closure member is in the third position. To facilitate draining of fluid from the vent tube, the inner end of the vent tube is lower than an outer end of the vent tube when the vent tube is mounted to a container that is in a resting position.

In another aspect, the pour spout includes a conduit member having a first end interconnectable with the container and a second end having a discharge opening, and a closure member positioned adjacent to the discharge opening. The closure member is movable relative to the conduit member between a first position where the discharge opening is closed, a second position where the discharge opening is closed, and a third position where the discharge opening is open. In accordance with this aspect of the invention, the pour spout further includes a closure locking device that prevents bypassing the second position during movement of the closure member from the first position to the third position.

In one embodiment, the closure locking device includes a first locking member positioned on the conduit member, and a second locking member positioned on the closure member. The first and second locking members are in alignment with each other when the closure member is in the first position to thereby prevent movement of the closure member to the third position. However, the first and second locking members are out of alignment with each other when the closure member is in the second position to thereby allow movement of the closure member to the third position. Preferably, the second position is rotationally displaced from the first position, and the third position is axially displaced from the second position.

In yet another aspect, the pour spout includes a conduit member having a first end interconnectable with the container and a second end having a vent opening, and a closure member positioned adjacent to the vent opening. The closure member is movable relative to the conduit member between a first position where the vent opening is closed, and a second position where the vent opening is open. A vent locking device prevents movement of the closure member from the first position to the second position when the container is tipped beyond a predetermined angle (i.e., tipped forward from the container's resting position).

In one embodiment, the vent locking device includes a locking member (e.g., a locking ball) movable between a locked position where the locking member interferes with movement of the closure member from the first position to the second position and an unlocked position where the locking member is free from interference with movement of the closure member from the first position to the second position. Preferably, the vent locking device includes an inclined surface having a first end that supports the locking member in the unlocked position and a second end that supports the locking member in the locked position, the locking member being movable between the first and second ends. In one embodiment, the first end is lower than the second end when the pour spout is mounted to a container in a resting position, and the first end is higher than the second end when the pour spout is mounted to a container that is tilted to a predetermined angle (e.g., greater than about 10 degrees). For example, the locked position can correspond with the locking member being circumferentially positioned between the conduit member and the closure member to thereby prevent rotation of the closure member relative to the conduit member from the first position to the second position.

In still another aspect, the pour spout includes a conduit member having a first end interconnectable with the container and a second end having a discharge opening, and a vent tube having an inner end and an outer end. The vent tube is designed to allow gas to enter the container when fluid is being discharged from the container. The pour spout further includes a mechanism for forming an air pocket around the inner end of the vent tube when the container is tipped, thereby inhibiting the entry of fluid into the vent tube at its inner end when the container is inverted for any reason.

In one embodiment, the mechanism for forming an air pocket includes a cup-shaped member positioned around the inner end of the vent tube. For example, the cup-shaped member can include a fine screen element which allows passage of liquid while inhibiting the passage of gas through the fine screen element. In addition, the cup-shaped member can further include a coarse screen element which allows passage of liquid and gas through the coarse screen element.

In another aspect, the pour spout includes a conduit member having a first end interconnectable with the container and a second end having a discharge opening and a vent opening, and a closure member positioned adjacent to the discharge opening. The closure member is movable relative to the conduit member between a first position where the discharge and vent openings are closed, a second position where the vent opening is open, and a third position where the discharge opening is open. The pour spout further includes a means for retaining a sub-ambient pressure within the container when the closure member is in the first and second positions.

In one embodiment, the retaining means comprises a one-way valve (e.g., a ball valve) positioned to inhibit flow of gas into the container. In another embodiment, the retaining means further comprises a mechanism for holding the one-way valve in an open position when the closure member is in the third position. Preferably, the holding mechanism includes a push rod that engages the one-way valve and prevents the one-way valve from moving to a closed position when the closure member is in the third position. For example, the push rod can be interconnected with the conduit member and the one-way valve can be interconnected with the closure member such that, when the closure member is moved relative to the conduit member from the second position to the third position, the push rod will move relative to the one-way valve.

BRIEF DESCRIPTION OF THE DRAWINGS

FIG. 7 is section view of the pour spout taken along line 7—7 in FIG. 4;

FIG. 8 is a section view of the pour spout taken along 8—8 in FIG. 7;

FIG. 9 is a section view of the vent lock taken along line 9—9 in FIG. 7;

FIG. 10 is a section view of the vent lock taken along line 10—10 in FIG. 9.

FIG. 11 is an enlarged partial section view of the interaction between a latch member and a boss member, with the closure member in the vented position;

FIG. 12 is a section view taken along line 12—12 in FIG. 11;

FIG. 16 is a section view taken along line 16—16 in FIG. 13;

FIG. 17 is a section view taken along line 17—17 in FIG. 16;

FIG. 18 is a section view taken along line 18—18 in FIG. 16;

FIG. 19 is the same view as FIG. 18 and illustrates the locking ball interfering with movement of the closure member to the vented position;

FIG. 20 is the section view of FIG. 15 illustrating the position of the closure member when the lock ball prevents movement of the closure member to the vented position;

FIG. 21 is the section view of FIG. 18 with the container tipped and the lock ball resting against the first detail of the closure member.

FIG. 22 is a side view of the pour spout fully inserted into a neck of a container with the closure member in the discharge position;

FIG. 23 is an enlarged partial section view of the pour spout illustrating the interaction between a latch member and a boss member;

FIG. 24 is a section view taken along line 24—24 in FIG. 23;

FIG. 26 is a section view taken along line 26—26 in FIG. 25;

FIG. 30 is a section view taken along line 30—30 in FIG. 25;

FIG. 31 is a section view taken along line 31—31 in FIG. 30;

FIG. 32 is a section view taken along line 32—32 in FIG. 30;

FIG. 33 is a section view taken along line 33—33 in FIG. 32;

FIG. 34 is a side view of the pour spout fully inserted into a receiving tank having a vertical neck;

FIG. 35 is a side view of the pour spout inserted into a receiving having an inclined neck;

FIG. 36 is the enlarged partial section view of FIG. 23 illustrating interaction between a boss member and a latch member as the boss member moves from the discharge position back to the sealed position;

FIG. 37 is a section view taken along line 38—38 in FIG. 36;

FIG. 38 is a section view taken along line 38—38 in FIG. 36.

FIG. 39 is an alternative embodiment of the filter housing of the present invention.

DETAILED DESCRIPTION

Figure 1:
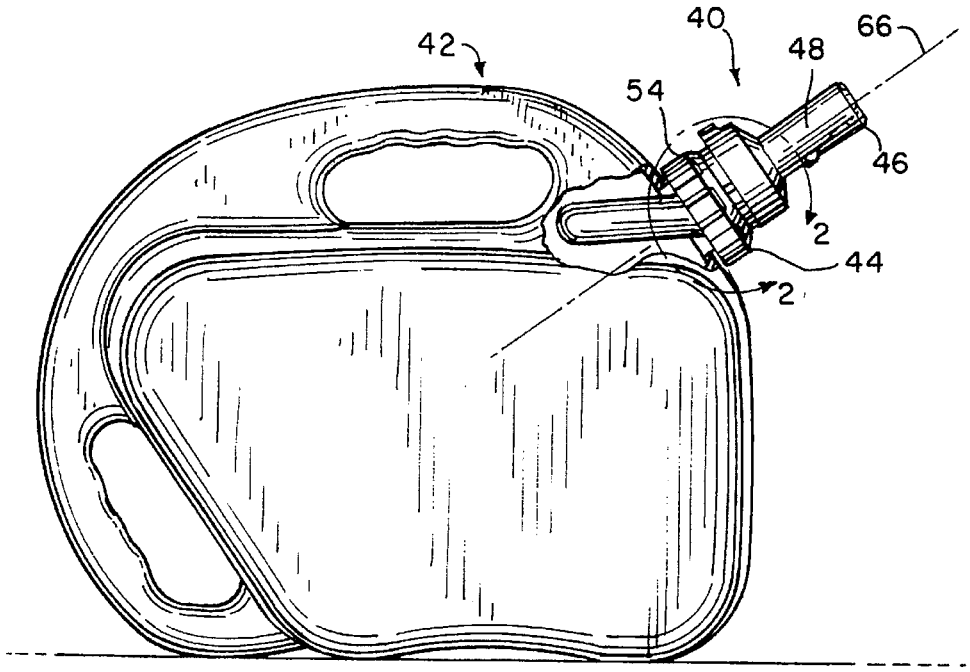
FIG. 1 is a side view of the pour spout attached to the container, with the container shown in partial section.

FIGS. 1–38 illustrate one embodiment of the present invention. Referring specifically to FIGS. 1–6, the illustrated apparatus generally comprises a pour spout 40 detachably connected to a container 42. The pour spout 40 includes a conduit member 44, an end cap member 46 rigidly secured to the conduit member 44 (i.e., the end cap member 46 is essentially part of the conduit member 44), and a closure member 48 positioned around the exterior of the conduit member 44. The conduit member 44 includes two discharge ports 50 (FIGS. 4 and 6) which provide a passageway through which fluid can be dispensed from the container 42 through the pour spout 40. In addition, the conduit member 44 includes a vent opening 52 through which gas can exit the container 42 (i.e., via the vent member 100, described below) to vent the container 42 prior to discharging fluid, and through which air can enter the container 42 (i.e., via the vent member 100, described below) during discharge of fluid from the container 42. The closure member 48 is movable relative to the conduit member 44 between a sealed position (i.e., discharge ports 50 and vent opening 52 closed), a vented position (i.e., vent opening 52 open), and a discharge position (i.e., discharge ports 50 open), as will be described below in more detail.

Figures 4, 5, 6:
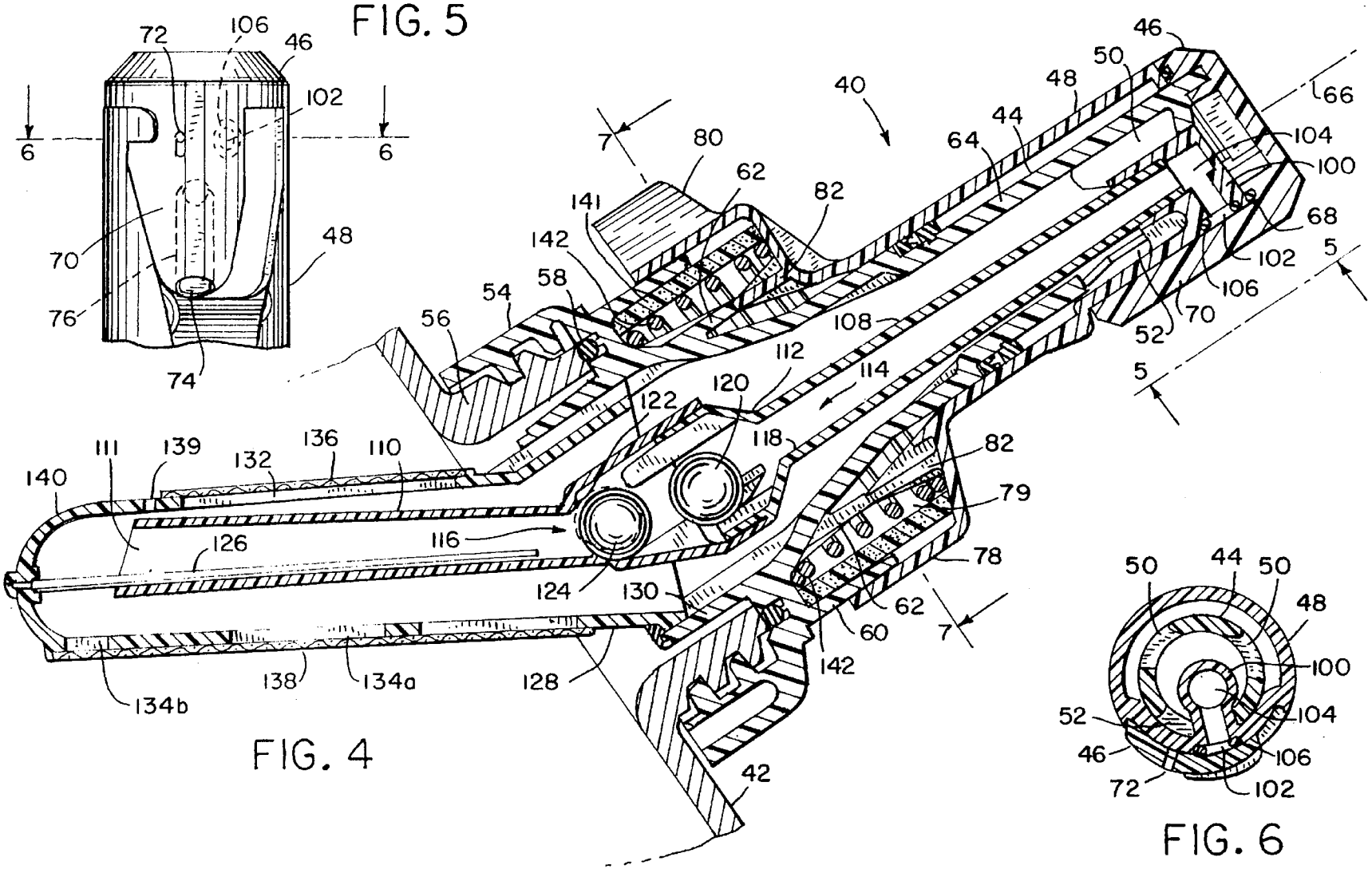
FIG. 4 is a side section view of the pour spout illustrated in FIG. 1.
FIG. 5 is a front view of the tip of the pour spout taken along line 5—5 in FIG. 4.
FIG. 6 is a section view of the pour spout taken along line 6—6 in FIG. 5.

The conduit member 44 includes a threaded portion 54 which is threaded to a neck 56 of the container 42 (FIG. 4). A conduit O-ring 58 provides a seal between the conduit member 44 and the neck 56 of the container 42. The threads of the threaded portion 54 and the neck 56 are uniquely designed so that the pour spout 40 can only be used with the appropriate container 42, and vice versa. The conduit member 44 further includes an upwardly-extending annular flange 60 and upwardly-extending locking members 62. The annular flange 60 and upwardly-extending locking members 62 are designed to cooperate with similar details on the closure member 48, the functions of which will be described below. The conduit member 44 further includes a tubular discharge portion 64 for directing fluid toward the discharge ports 50. Each of the features described in this paragraph is concentric with a center axis 66.

The vent opening 52 of the conduit member 44 is designed to provide two distinct functions, as briefly noted above. First, the vent opening 52 provides a passageway through which gas can exit the pour spout 40 to vent the container 42 prior to discharging fluid. Second, the vent opening 52 provides a passageway through which air is allowed to enter the pour spout 40 while fluid is being discharged from the container 42, thereby inhibiting surging of fluid during discharge. These two functions of the vent opening 52 are provided by the interaction between the closure member 48 and the end cap member 46, as will be described below.

The end cap member 46 of the illustrated embodiment is rigidly secured to the tip of the conduit member 44 (FIGS. 4 and 5). The end cap member 46 includes an end cap O-ring 68 which provides a seal between the end cap member 46 and the closure member 48, thereby inhibiting the leakage of fluid therebetween when the closure member 48 is butted up against the end cap (i.e., when the closure member 48 is in the sealed position or vented position). The end cap member 46 includes an extended portion 70 which extends parallel to the center axis 66 toward the container 42. The extended portion 70 is positioned adjacent to the closure member 48 and includes two orifices: an outlet orifice 72 and an inlet orifice 74.

Figures 13, 14, 15:
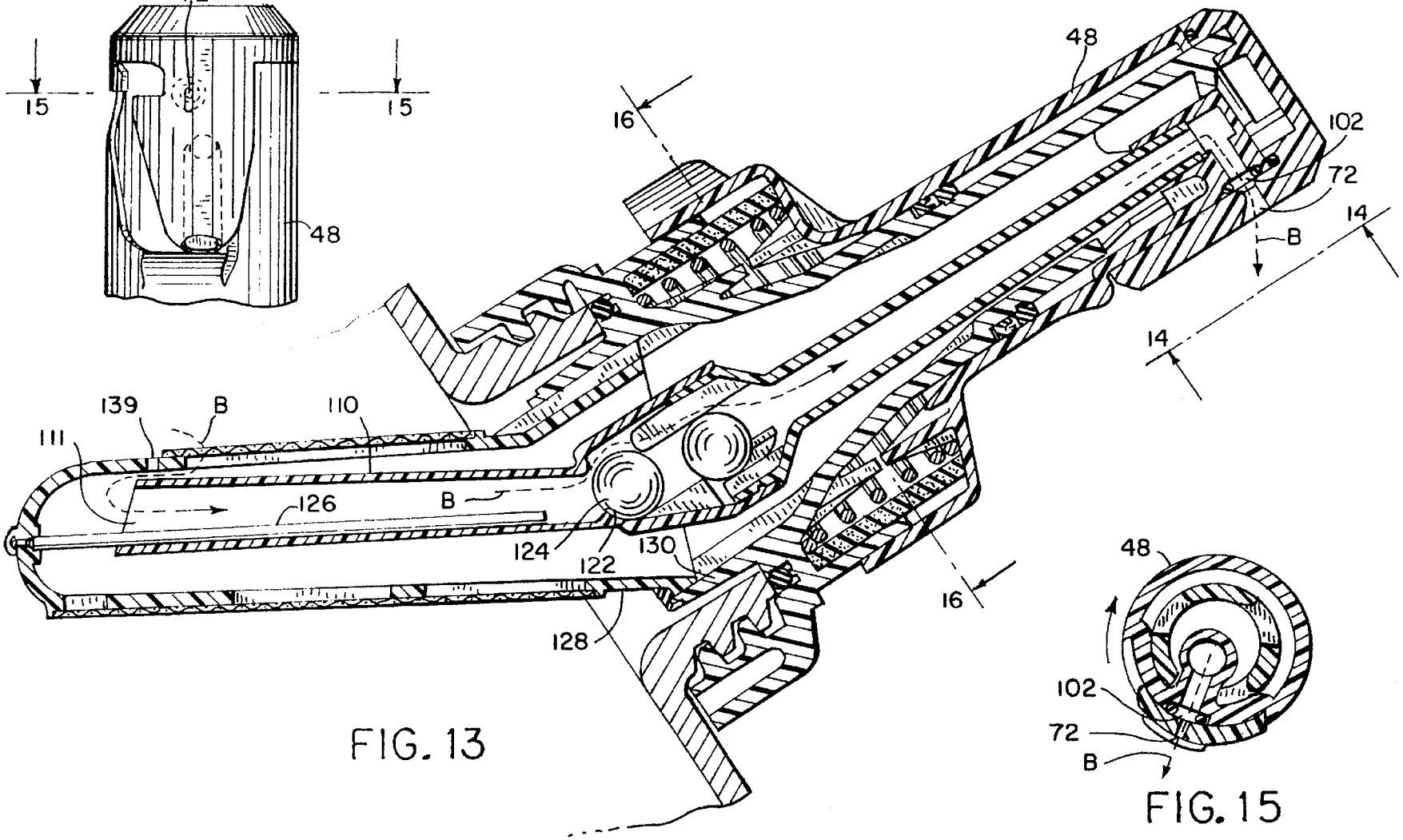
FIG. 13 is a side section view of the pour spout with the closure member in the vented position.
FIG. 14 is a front view of the tip of the pour spout taken along line 14—14 in FIG. 13.
FIG. 15 is a section view taken along line 15—15 in FIG. 14.

The outlet orifice 72 provide a path through which pressurized gas within the container 42 can exit to the atmosphere (i.e., via the vent opening 52) when the closure member 48 is in the vented position (FIG. 13). The outlet orifice 72 is specifically designed to make a noise (e.g., a whistling noise) when gas exits the container 42 so as to provide an audible indication that venting of the container 42 is occurring.

Figure 25:
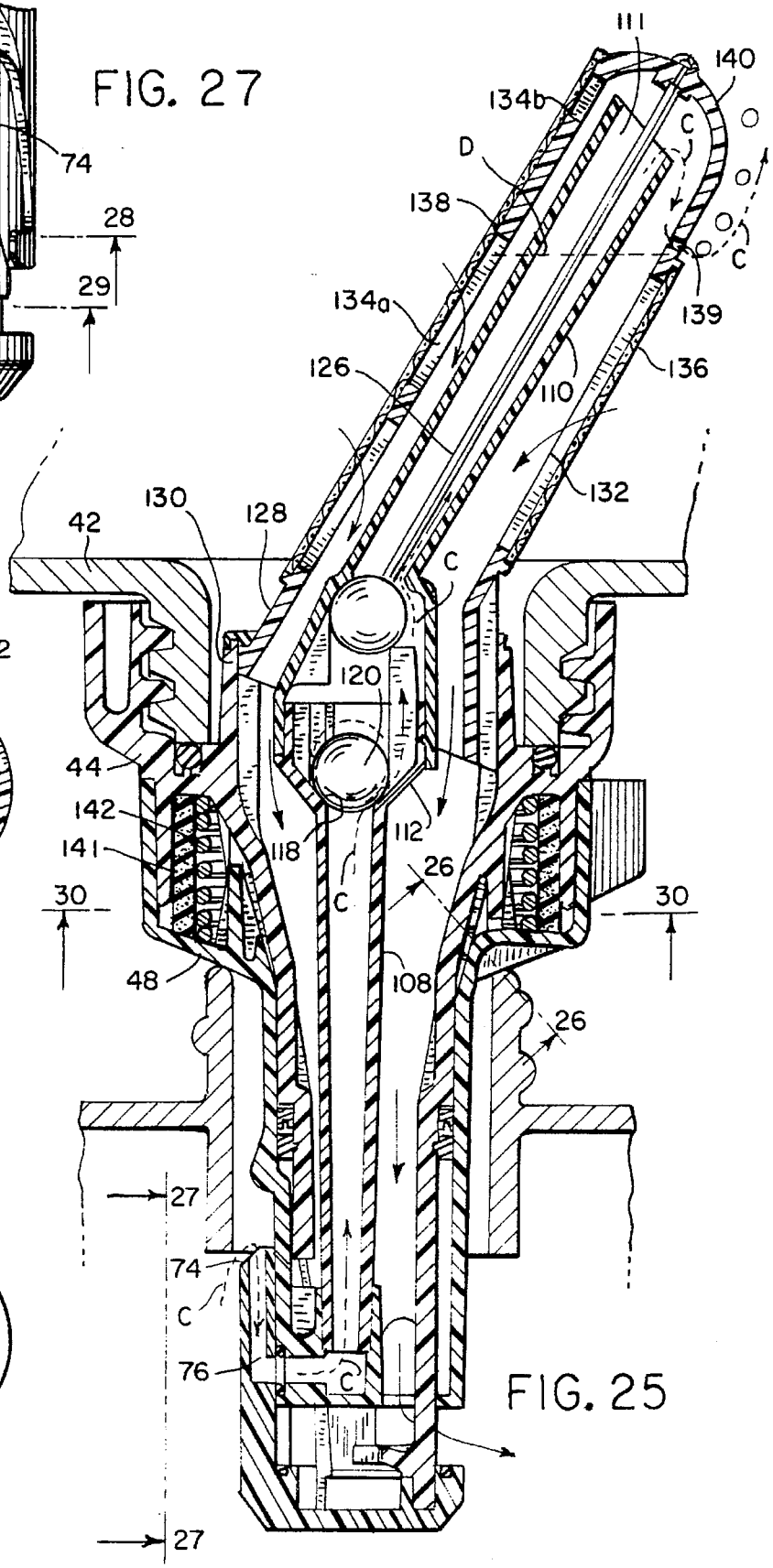
FIG. 25 is a side section view of the pour spout illustrated in FIG. 22.

The inlet orifice 74 is interconnected with an inlet passageway 76 which allows gas (e.g., air) to enter the container 42 (i.e., via the vent opening 52) when the closure member 48 is in the discharge position and fluid is being discharged through the pour spout 40 (FIG. 25). The inlet orifice 74 and inlet passageway 76 inhibit surging of the fluid during discharge of fluid from the container 42. The inlet orifice 74 is positioned about 30 mm from the tip of the end cap. Such positioning of the inlet orifice 74 allows the receiving tank 77 to be filled to a higher level (i.e., compared to positioning the inlet orifice 74 closer to the tip of the end cap). Further, such positioning of the inlet orifice 74 helps to maintain the position of the inlet orifice 74 near the inner tank edge 75, while keeping the discharge ports 50 below the inner tank edge 75 when fuel is being discharged. This is true even when discharging through an angled tank neck 56, thereby ensuring that fluid flow will be unhindered by the tank neck and flow will stop at its highest possible level when the inlet orifice 74 is covered by the rising fluid level (FIGS. 34 and 35). Such positioning also assists in providing an audible indication that filling is ceasing as fluid and air will flow into the inlet orifice and passageway making a gurgling sound.

The closure member 48 of the illustrated embodiment is positioned around an exterior of the conduit member 44, and between the conduit member 44 and the extended portion 70 of the end cap. The closure member 48 includes a downwardly-extending skirt 78 which cooperatively engages with the upwardly-extending flange to form a spring compartment 79. A tab member 80 is secured to the skirt 78 to facilitate engagement and rotation of the closure member 48 by a user of the apparatus. The tab member 80 is advantageously positioned on an upper side of the skirt 78 so that the tab member 80 is visible to the user of the apparatus, and so that the tab member 80 remains free from fluids that might drip from the pour spout 40.

The closure member 48 further includes downwardly-extending locking members 82 which coact with the upwardly-extending locking members 62 to provide a locking mechanism (FIG. 4). More specifically, the downwardly-extending locking members 82 are positioned such that they are in alignment with the upwardly-extending locking members 62 when the closure member 48 is in the sealed position (FIG. 8), thereby preventing the closure member 48 from being moved axially relative to the conduit member 44 and, thus, preventing opening of the discharge ports 50. When the closure member 48 is rotated to the vented position, the downwardly-extending locking members 82 are out of alignment with the upwardly-extending locking members 62 (FIG. 17). Such positioning of the upwardly-extending locking members 62 allows the closure member 48 to be moved axially relative to the conduit member 44, resulting in by passing of the upwardly-extending locking members 62 and the downwardly-extending locking members 82 (FIG. 31) and, thus, allowing opening of the discharge ports 50.

The above-described locking mechanism provides three distinct features. First, the locking mechanism inhibits accidental opening of the discharge ports 50 in the event that the container 42 accidentally tips over. Second, the locking mechanism forces the user of the device to vent the container 42 before the discharge ports 50 can be opened, thereby reducing the likelihood that fluid will spurt from the pour spout 40 upon opening of the discharge ports 50. Finally, the locking members provide additional support to the end cap member 46 (i.e., in addition to the conduit member 44). Such support reduces the chance of failure in the event that a large axial force is applied to end cap (e.g., if the container 42 is dropped) by distributing some of the force through the closure member 48 to the base of the conduit member 44, thereby bypassing the weaker section of the conduit member near the discharge ports.

The pour spout 40 further includes a vent lock for preventing venting of the container 42 when the container 42 is tipped (i.e., where fluid would cover the vent tube inlet), thereby reducing the potential for spurting of fluid caused by a pressurized container 42. The vent lock includes a lock ball 84 freely positioned within an inclined groove 86 in the conduit member 44 between an upstanding wall 88 and the discharge portion 64 (FIGS. 7, 9 and 10). The vent lock further includes a first detail 90 extending downwardly from the closure member 48, and a second detail 92 extending upwardly from the conduit member 44 (FIG. 10). It should be noted that FIG. 10 depicts the vent lock as it appears on a container 42 in its resting position. That is, the arrow A in FIG. 10 points toward the end cap member 46, parallel to the center axis 66. When the closure member 48 is in the sealed position, there is a gap 94 positioned circumferentially between the first detail 90 and the second detail 92. However, when the closure member 48 is rotated to the vented position, the first detail 90 moves toward the second detail 92 to significantly narrow the gap 94 (FIG. 18).

The above-mentioned inclined groove 86 (FIG. 10) is oriented such that, when the container 42 is resting on a flat surface, it is inclined approximately 10° from a first end 96 of the inclined groove 86 to a second end 98 of the inclined groove 86. The first end 96 of the inclined groove 86 is located axially (i.e., parallel to the center axis 66) below the first detail 90 of the closure member 48, and the second end 98 of the incline surface is located in the circumferential gap 94 formed between the first detail 90 and the second detail 92 when the closure member 48 is in the sealed position.

With the lock ball 84 freely positioned within the inclined groove 86 and with the container 42 resting on a flat surface, the lock ball 84 with be positioned at the first end 96 of the inclined groove 86 due to the slight inclination of the inclined groove 86. With the closure member 48 in the sealed position, there will be a circumferential gap 94 between the first detail 90 of the closure member 48 and the second detail 92 of the conduit member 44 (FIG. 10). If the container 42 is tipped forward from the resting condition (i.e., tipped in the direction of the pour spout 40) with the closure member 48 in the sealed position, the inclined groove 86 will be tipped such that the second end 98 is lower than the first end 96, thereby resulting in the lock ball 84 rolling to the second end 98 where it is positioned within the circumferential gap 94 (FIG. 19). If the user of the apparatus subsequently attempts to vent the container 42 (i.e., rotate the closure member 48 from the sealed position to the vented position), the first detail 90 of the closure member 48 will move toward the second detail 92 of the conduit member 44. However, because of the positioning of the lock ball 84 between the first detail 90 and the second detail 92, the conduit member 44 will be prevented from moving to the vented position (FIG. 19).

Conversely, with the container 42 positioned on a flat surface in a resting condition, the lock ball 84 will be positioned at the first end 96 of the inclined groove 86, and therefore will not interfere with movement of the first detail 90 toward the second detail 92, thereby allowing the closure member 48 to be moved from the sealed position to the vented position (FIG. 18). Once the closure member 48 is in the vented position, subsequent tilting of the container 42 will cause the lock ball 84 to contact the first detail 90 (FIG. 21). Because of the axial positioning of the inclined groove 86 relative to the first detail 90, the lock ball 84 will not interfere with subsequent axial movement of the closure member 48 (i.e., the first detail 90) to the discharge position (FIGS. 32 and 33).

The closure member 48 further includes a vent member 100 extending into the interior of the conduit member 44 through the vent opening 52 (FIGS. 4–6). Air passing through the vent opening 52 in the conduit member 44 actually travels through the vent member 100. The vent member 100 includes a vent orifice 102 leading to a vent path 104 extending through the vent member 100 for providing a pathway through which gas can exit the container 42 during venting, and through which air may enter the container 42 during discharge of fluid from the container 42. A vent O-ring 106 is provided around the vent orifice 102 to provide a seal between the vent orifice 102 and the end cap member 46.

Figure 27:
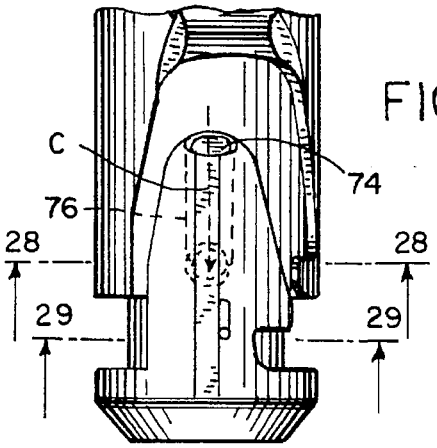
FIG. 27 is a side view of the pour spout taken along line 27—27 in FIG. 25.
Figure 28:
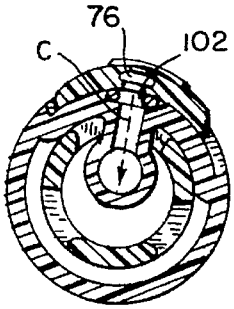
FIG. 28 is a section view taken along line 28—28 in FIG. 27.
Figure 29:
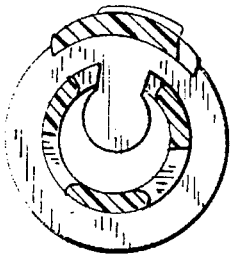
FIG. 29 is a section view taken along line 29—29 in FIG. 27.

The vent orifice 102 in positioned such that it is in alignment with the extended portion 70 of the end cap when the closure member 48 is in the sealed position, thereby effectively sealing the container 42 (FIGS. 4–6). When the closure member 48 is in the vented position, the vent orifice 102 is in alignment with the outlet orifice 72 in the end cap member 46, thereby allowing pressurized gas to exit the container 42 along a path shown by arrows B (FIGS. 13–15). When the closure member 48 is in the discharge position, the vent orifice 102 is in alignment with the inlet passageway 76 in the end cap, thereby allowing air to enter the container 42 along a path shown by arrows C during discharge of fluid from the container 42 (FIGS. 25, 27 and 28). It should be noted that the vent lock, described above, prevents the outlet orifice 72 from becoming aligned with the vent orifice 102 when the container is tipped forward (FIG. 20).

To provide control of air entering the vent orifice 102, a first vent tube 108 is interconnected with the vent member 100 and a second vent tube 110 is interconnected with the first vent tube 108 to thereby effectively extend the vent path 104 so that the inner end of the vent path 104 (i.e., the open end 111 of the second vent tube 110) is positioned within the container 42 (FIG. 4). By virtue of such positioning, air entering the container 42 during discharge of fluid from the container 42 does not significantly interfere with the flow of fluid through the conduit member 44.

The intersection of the first vent tube 108 with the second vent tube 110 defines an enlarged valve chamber 112 which contains a pressure valve 114 and a vacuum valve 116. The pressure valve 114 includes a pressure valve seat 118 formed integral with the first vent tube 108, and a pressure ball 120 moveable between an open position (FIG. 4) and a closed position (FIG. 25). When the container 42 is resting on a flat surface (FIG. 4), the pressure ball 120 will always be in the open position, thereby allowing venting of the container 42. The pressure ball 120 is positioned and weighted so that it will not be forced into the closed position when gas is being vented from the container 42. When the container 42 is tipped forward (FIG. 25), the pressure ball 120 will be seated against the pressure valve seat 118, thereby preventing flow of fluid from the container 42 into the first vent tube 108, but allowing flow of air from the first vent tube 108 to the container 42 (i.e., via the second vent tube 110).

The vacuum valve 116 includes a vacuum valve seat 122 formed integral with the second vent tube 110, and a vacuum ball 124 moveable between an open position (solid lines in FIG. 4) and a closed position (dashed lines in FIG. 4). The vacuum valve 116 inhibits air from entering the container 42 (e.g., through the inlet and outlet orifices 72,74) when the pressure within the container 42 is less than the atmospheric pressure (i.e., a low pressure). That is, the vacuum ball 124 is positioned and weighted so that, if a low pressure is in the container 42 when the container 42 is vented (with the container in a resting position), the vacuum ball 124 will be drawn against the vacuum valve seat 122, thereby inhibiting entrance of air into the container 42. The purpose of this feature is to inhibit a user from attempting to overfill a tank 77 by performing successive filling attempts (i.e., by removing the pour spout 40 after fluid flow has stopped, preventing the container 42 thereby eliminating the low pressure in the container 42, and subsequently inserting the pour spout 40 back into the filled tank 77). Even though the pour spout 40 and inlet orifice 74 would be covered by the fluid in the tank 77, successive filling attempts would allow some fluid to discharge into the tank 77 until a low pressure was again formed in the container 42. This can amount to a significant amount of fluid compared to the size of the receiving tank. By providing the vacuum valve 116 of the present invention, the low pressure created in the container 42 will be maintained for a finite period of time, thereby inhibiting overfilling of the tank 77 by successive filling attempts.

The vacuum valve 116 further includes a plunger member 126 which contacts the vacuum ball 124 and holds the vacuum ball 124 in the open position when the closure member 48 is in the discharge position (FIG. 25). Such positioning of the plunger member 126 allows air to pass through the vent tube during discharge of fluid from the container 42. Without the plunger member 126, the vacuum ball 124 could move to the closed position (dashed lines in FIG. 4) due to the flow of air into the container 42 during discharge of fluid, thereby stopping air flow through the vent opening 52 and resulting in surging of fluid flow through the pour spout 40. The plunger member 126 also allows flow to start smoothly when filling an empty receiving tank from a container with a sub-ambient pressure.

The plunger member 126 is interconnected with a filter housing 128 which is, in turn, interconnected with a downwardly-extending annular portion 130 which forms the innermost part of the conduit member 44 and through which fluid must flow to reach the discharge ports 50. Because the plunger member 126 is interconnected with the conduit member 44 and the second vent tube 110 is interconnected with the closure member 48, the plunger member 126 remains stationary with the conduit member 44 as the closure member 48 and associated second vent tube 110 are moved from the vented position to the discharge position. When the closure member 48 is in the vented position, the plunger member 126 does not interfere with the vacuum ball 124 (FIG. 13). However, when the closure member 48 is in the discharge position, the plunger member 126 extends through the second vent tube 110 and into the vacuum valve seat 122 to hold the vacuum ball 124 in the open position (FIG. 25).

In order to create a low pressure in the container 42 after the inlet orifice 74 has been covered with fluid, an extra amount of fluid will exit the pour spout 40, as generally described above. To create room in the receiving tank 77 for this extra fluid, a certain amount of air within the tank 77 must be expelled to the atmosphere. If the pour spout was sealed to the tank neck 56, no such air would be allowed to escape the tank, and no low pressure would be formed in the container. Accordingly, to ensure that air is allowed to escape the tank 77, the closure member 48 includes a non-sealing lip 131 that maintains a small gap 133 between the closure member 48 and the tank neck 56. The small gap 133 is deliberately made small to lessen the amount of fluid vapors (e.g., fuel vapors) that exits the tank neck 56 during filling of the tank 77.

The filter housing 128 includes an upper opening 132 and a lower opening 134, both of which provide for the flow of fluid into and out of the filter housing 128 (FIG. 4). Since the filter housing 128 completely encloses the inner end of the conduit member 44, fluid flowing from the container 42 to the conduit member 44 must pass through either the upper opening 132 or the lower opening 134*a*. The upper opening 132 is provided with a coarse filter element 136 which filters impurities from the fluid as the fluid passes from the container 42 to the conduit member 44. The lower opening 134*a* includes a fine filter element 138 which similarly filters impurities from the fluid as the fluid passes from the container 42 to the conduit member 44.

The filter housing 128 includes a cupped portion 140 adjacent the location where the plunger is connected to the filter housing 128. The cupped portion 140 is positioned such that the open end 111 of the second vent tube 110 is within the cupped portion 140. The cupped portion 140 is designed to retain a pocket of air when the container 42 and pour spout 40 are tipped into a pouring position (FIG. 25).

Retention of the pocket of air is facilitated by the use of the fine filter element 138 in the lower opening 134*b* of the filter housing 128. More specifically, the fine filter element 138 is designed such that, when it is wetted with fluid, it inhibits the flow of air, but allows the flow of fluid, through the fine filter element 138 when fluid drains back from the pour spout 40 after pouring. Accordingly, with the apparatus tipped in a pouring position (FIG. 25), air is only allowed to exit the filter housing 128 through the coarse filter element 136 or holes 139 and, accordingly, a pocket of air will be formed within the cupped portion 140 as generally indicated by the dashed line D in FIG. 25. The pocket of air inhibits the flow of fluid into the second vent tube 110, thereby keeping the first and second vent tubes 108,110 and associated pressure valve 114 and vacuum valve 116 relatively dry. In the event that fluid should enter the second vent tube 110, the fluid will be allowed to drain from the vent tube when the container 42 is placed back in its resting position by virtue of the fact that the first and second vent tubes 110 are angled downwardly toward the open end 111 of the second vent tube 110 (FIGS. 1 and 4).

A biasing spring 142 is positioned within the spring compartment 79 to bias the closure member 48 toward the sealed position. The biasing spring 142 comprises a combination torsion and compression spring which is interconnected on its top and with the closure member 48 and on its bottom and with the conduit member 44. When the closure member 48 is in its sealed position (FIG. 7), the biasing spring 142 is under compressive and torsional loading such that it tends to hold the closure member 48 in the sealed position. As the closure member 48 is rotated from the sealed position to the vented position (FIG. 16), the biasing spring 142 is further torqued from its resting position, thereby increasing the torque applied by the biasing spring 142 on the closure member 48. When the closure member 48 is subsequently moved from the vented position to the discharge position (FIG. 25), the biasing spring 142 is further compressed from its resting position, thereby increasing the axial force applied by the biasing spring 142 on the closure member 48. Accordingly, it can be appreciated that the biasing spring 142 biases the closure member 48 from the discharge position and the vented position to the sealed position.

A foam jacket 141 (FIGS. 4 and 7) is provided around the biasing spring 142 to inhibit the entry of contaminants into the space between the closure member 48 and the conduit member 44. Preferably, the foam jacket 141 is formed from a polyether open cell foam material that has sufficient resiliency in the axial direction to permit compression (FIG. 25) and recovery (FIG. 4) to its original shape.

Figure 2:
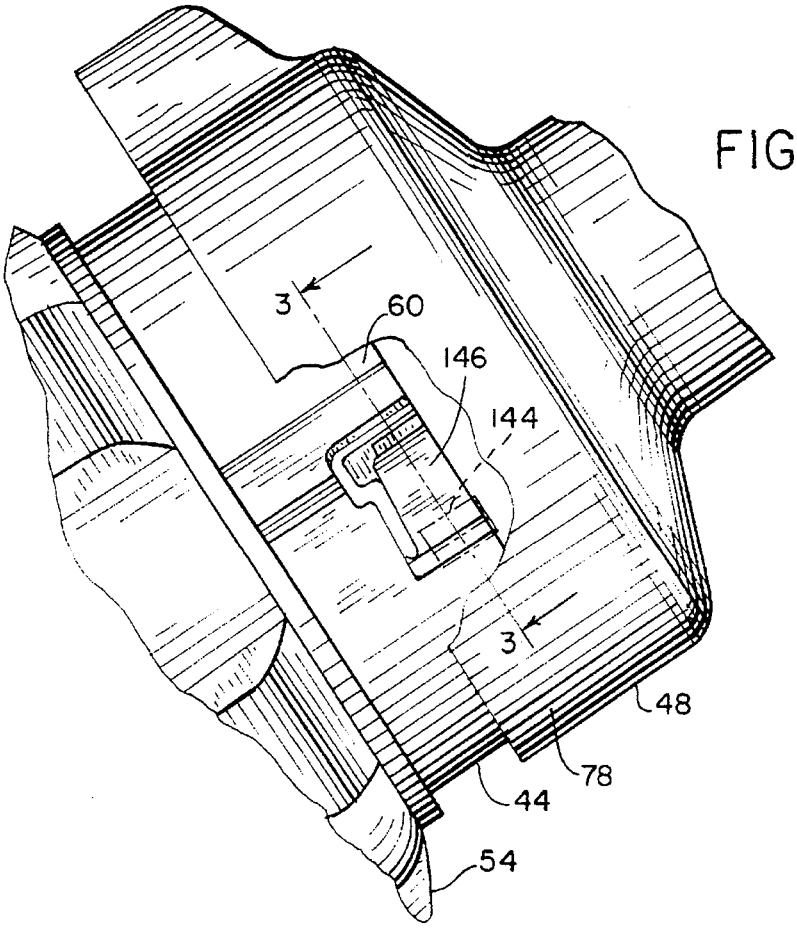
FIG. 2 is an enlarged partial section view of FIG. 1, showing the interaction between a latch member and a boss member.
Figure 3:
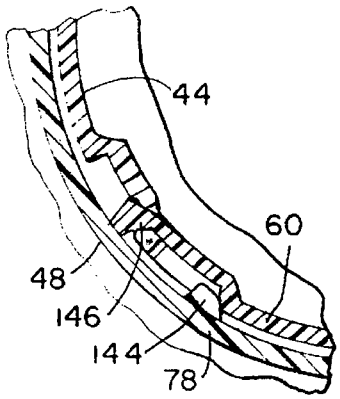
FIG. 3 is a section taken along line 3—3 in FIG. 2.

In order to maintain the closure member 48 in the vented position after movement from the sealed position, the closure member 48 is provided with two engaging bosses 144 on opposing sides of the inside surface of the downwardly-extending skirt 78 (FIGS. 2, 3 and 7). The two engaging bosses 144 coact with two corresponding flexibly-mounted lever members 146 which form a portion of the annular flange 60 of the conduit member 44. More specifically, the lever members 146 are designed such that they contact the engaging bosses 144 as the closure member 48 is moved from the sealed position to the vented position. However, due to the flexible mounting of the lever members 146 to the annular flange 60, the lever members 146 will flex inwardly as they come into contact with the engaging bosses 144, thereby allowing the engaging bosses 144 to pass. Once the engaging bosses 144 have completely passed the lever members 146, the lever members 146 will flex back to their original position, thereby inhibiting movement of the engaging bosses 144 and associated closure member 48 back to the sealed position (FIGS. 11, 12 and 16). In fact, the lever members 146 are designed such that the closure member 48 will not move from the vented position back to the sealed position without external force being applied by the user. That is, when the user rotates the closure member 48 from the sealed position to the vented position and then releases the closure member 48, the closure member 48 will remain in the vented position even though the biasing spring 142 applies a biasing torque which biases the closure member 48 toward the sealed position.

With the closure member 48 in the vented position, the closure member 48 may be moved to the discharge position, thereby causing the engaging bosses 144 to move axially into a recess 148 formed into the annular flange 60 of the conduit member 44 (FIGS. 23 and 24). When positioned in the recess 148, the engaging bosses 144 no longer engage the lever members 146. In addition, the recess 148 in the flange portion is dimensioned such that, when the engaging bosses 144 are positioned therein and biased toward the sealed position (i.e. due to the torque applied by the biasing spring 142), the engaging bosses 144 are positioned in axial alignment with the lever members 146 (i.e., aligned in a direction parallel to the center axis 66, as shown in FIG. 23). The lever members 146 are each provided with an inclined face 150 which faces toward the engaging bosses 144 when the engaging bosses 144 are positioned within the recess 148 (i.e. when the closure member 48 is in the discharge position).

When discharge of fluid from the container 42 is complete and the pour spout 40 is withdrawn from the tank neck 56, the biasing spring 142 will force the closure member 48 axially toward the vented position. Such movement of the closure member 48 forces the engaging bosses 144 into contact with the inclined faces 150 of the lever members 146, thereby flexing the lever members 146 inward and out of interference with movement of the engaging bosses 144 (FIGS. 36–38). Once the engaging bosses 144 have exited the recess 148, they will automatically be rotated back to the sealed position due to the biasing torque applied by the biasing spring 142 (FIG. 2). Since the lever members 146 are flexed inward at this point, they do not interfere with such movement of the engaging bosses 144. After the engaging boss 144 has returned to the sealed position the lever members 146 will flex back to their original position (FIG. 3).

FIG. 39 illustrates an alternative embodiment of the present invention. FIG. 39 shows the filter housing 128' as it appears on an inverted container, similar to the filter housing 128 shown in FIG. 25. The illustrated filter housing 128' includes an air trap tube 152 interconnected with the cupped portion 140' of the filter housing 128'. The open end 154 of the air trap tube 152 extends below the level of the open end 111' of the second vent tube 110' so that a pocket of air is retained within the air trap tube 152. Such pocket of air facilitates keeping the open end 111' of the second vent tube 110' dry while still allowing fluid to drain from the filter housing 128' when the container is in a resting position.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A pour spout for conducting fluid from a container to a receptacle, said pour spout comprising:

a conduit member including a first end directly interconnectable with the container and a second end having a discharge opening and a vent opening; and a closure member positioned adjacent to said discharge opening, said closure member being movable relative to said conduit member between a first position where said discharge and vent openings are closed, a second position where said discharge opening is closed and said vent opening is open, and a third position where said discharge opening is open.

2. A pour spout, as claimed in claim 1, further comprising a closure locking device that prevents bypassing said second position during movement of said closure member from said first position to said third position.

3. A pour spout, as claimed in claim 2, wherein said closure locking device includes:

a first locking member positioned on said conduit member; and a second locking member positioned on said closure member, wherein said first and second locking members are in alignment with each other when said closure member is in said first position to thereby prevent movement of said closure member to said third position, and wherein said first and second locking members are out of alignment with each other when said closure member is in said second position to thereby allow movement of said closure member to said third position.

4. A pour spout, as claimed in claim 1, further comprising a vent locking device that prevents movement of said closure member from said first position to said second position when the container is tipped beyond a predetermined angle.

5. A pour spout, as claimed in claim 4, wherein said vent locking device includes a locking member movable between a locked position where said locking member interferes with movement of said closure member from said first position to said second position, and an unlocked position where said locking member is free from interference with movement of said closure member from said first position to said second position.

6. A pour spout, as claimed in claim 1, further comprising:

a vent tube having an inner end and an outer end, said vent tube being designed to allow gas to enter the container when fluid is being discharged from the container; and means for forming an air pocket around said inner end of said vent tube when the container is tipped, thereby inhibiting the entry of fluid into said vent tube from said inner end.

7. A pour spout, as claimed in claim 6, wherein said means for forming an air pocket includes a cup-shaped member positioned around said inner end of said vent tube.

8. A pour spout, as claimed in claim 7, wherein said cup-shaped member includes a fine screen portion which allows passage of liquid while inhibiting the passage of gas through said fine screen portion when wet.

9. A pour spout, as claimed in claim 1, further comprising means for retaining a sub-ambient pressure within the container when said closure member is in said first and second positions.

10. A pour spout, as claimed in claim 9, wherein said retaining means comprises a one-way valve positioned to inhibit flow of gas into the container.

11. A pour spout, as claimed in claim 10, wherein said retaining means further comprises means for holding said one-way valve in an open position when said closure member is in said third position.

12. A pour spout, as claimed in claim 1, wherein said conduit member further comprises a gas inlet opening that allows gas to enter the container when fluid is being discharged from the container.

13. A pour spout, as claimed in claim 12, wherein said gas inlet opening is spaced from a tip of said pour spout.

14. A pour spout, as claimed in claim 13, wherein said gas inlet opening is at least 15 mm from said tip.

15. A pour spout, as claimed in claim 13, wherein said gas inlet opening is at least 25 mm from said tip.

16. A pour spout, as claimed in claim 12, further comprising a vent tube having an inner end and an outer end positionable in alignment with each of said vent opening and said gas inlet opening.

17. A pour spout, as claimed in claim 16, wherein said outer end of said vent tube is substantially closed when said closure member is in said first position, wherein said outer end of said vent tube is positioned in alignment with said vent opening when said closure member is in said second position, and wherein said outer end of said vent tube is positioned in alignment with said gas inlet opening when said closure member is in said third position.

18. A pour spout, as claimed in claim 16, wherein said inner end of said vent tube is lower than an outer end of said vent tube when said vent tube is mounted to a container in a resting position to thereby allow drainage of fluid from said vent tube.

19. A pour spout, as claimed in claim 1, further comprising an engaging tab, extending from said closure member, that facilitates engagement of said closure member by a user.

20. A pour spout, as claimed in claim 1, wherein said discharge opening and vent opening are distinct openings.

21. A pour spout, as claimed in claim 1, wherein said second position is rotationally displaced from said first position, and wherein said third position is axially displaced from said second position.

22. A pour spout for conducting fluid from a container to a receptacle, said pour spout comprising:

a conduit member including a first end interconnectable with the container and a second end having a discharge opening;

a closure member positioned adjacent to said discharge opening, said closure member being movable relative to said conduit member between a first position where said discharge opening is closed, a second position where said discharge opening is closed, and a third position where said discharge opening is open, said closure member and conduit member defining an enclosed space proximal said first end;

a closure locking device that prevents bypassing said second position during movement of said closure member from said first position to said third position, said closure locking device being positioned within said enclosed space.

23. A pour spout, as claimed in claim 22, wherein said closure locking device includes:

a first locking member positioned on said conduit member; and a second locking member positioned on said closure member, wherein said first and second locking members are in alignment with each other when said closure member is in said first position to thereby prevent movement of said closure member to said third position, and wherein said first and second locking members are out of alignment with each other when said closure member is in said second position to thereby allow movement of said closure member to said third position.

24. A pour spout, as claimed in claim 23, wherein movement of said closure member from said second position to said third position is parallel to a longitudinal axis, and wherein said first and second locking members extend from said conduit and closure members, respectively, in a direction about parallel to said longitudinal axis.

25. A pour spout, as claimed in claim 22, wherein said second position is rotationally displaced from said first position.

26. A pour spout, as claimed in claim 25, wherein said third position is axially displaced from said second position.

27. A pour spout for conducting fluid from a container to a receptacle, said pour spout comprising:

a conduit member including a first end interconnectable with the container and a second end having a vent opening;

a closure member positioned adjacent to said vent opening, said closure member being movable relative to said conduit member between a first position where said vent opening is closed, and a second position where said vent opening is open; and a vent locking device that prevents movement of said closure member from said first position to said second position when the container is tipped beyond a predetermined angle.

28. A pour spout, as claimed in claim 27, wherein said vent locking device includes a locking member movable between a locked position where said locking member interferes with movement of said closure member from said first position to said second position and an unlocked position where said locking member is free from interference with movement of said closure member from said first position to said second position.

29. A pour spout, as claimed in claim 28, wherein said vent locking device includes an inclined surface having a first end that supports said locking member in said unlocked position and a second end that supports said locking member in said locked position, said locking member being movable between said first and second ends.

30. A pour spout, as claimed in claim 29, wherein said first end is lower than said second end when said pour spout is mounted to a container resting on a level surface.

31. A pour spout, as claimed in claim 30, wherein said first end is higher than said second end when said pour spout is mounted to a container that is tilted to a predetermined angle.

32. A pour spout, as claimed in claim 31, wherein said predetermined angle is greater than about 10 degrees.

33. A pour spout, as claimed in claim 28, wherein said locked position corresponds with said locking member being circumferentially positioned between said conduit member and said closure member to thereby prevent rotation of said closure member relative to said conduit member from said first position to said second position.

34. A pour spout, as claimed in claim 28, wherein said locking member comprises a locking ball.

35. A pour spout for conducting fluid from a container to a receptacle, said pour spout comprising:

a conduit member including a first end interconnectable with the container and a second end having a discharge opening;

a vent tube having an inner end and an outer end, said vent tube being designed to allow gas to enter the container when fluid is being discharged from the container; and means for forming an air pocket around said inner end of said vent tube when the container is tipped, thereby inhibiting the entry of fluid into said vent tube from said inner end.

36. A pour spout, as claimed in claim 35, wherein said means for forming an air pocket includes a cup-shaped member positioned around said inner end of said vent tube.

37. A pour spout, as claimed in claim 36, wherein said cup-shaped member includes a fine screen element which allows passage of liquid while inhibiting the passage of gas through said fine screen element.

38. A pour spout as claimed in claim 37, wherein said cup-shaped member further includes a coarse screen element which allows passage of liquid and gas through said coarse screen element.

39. A pour spout as claimed in claim 35, wherein said means for forming an air pocket includes a downwardly-extending tubular member interconnected said inner end of said vent tube.

40. A pour spout for conducting fluid from a container to a receptacle, said pour spout comprising:

a conduit member including a first end interconnectable with the container and a second end having a discharge opening and a vent opening;

a closure member positioned adjacent to said discharge opening, said closure member being movable relative to said conduit member between a first position where said vent opening is closed, and a second position where said vent opening is open; and means for retaining a sub-ambient pressure within the container when said closure member is in said second position.

41. A pour spout, as claimed in claim 40, wherein said retaining means comprises a one-way valve positioned to inhibit flow of gas into the container.

42. A pour spout, as claimed in claim 41, wherein said one-way valve comprises a ball valve.

43. A pour spout, as claimed in claim 41, wherein said closure member is further movable relative to said conduit member to a third position where said discharge opening is open, and wherein said retaining means further comprises means for holding said one-way valve in an open position when said closure member is in said third position.

44. A pour spout, as claimed in claim 43, wherein said holding means comprises a push rod that engages said one-way valve and prevents said one-way valve from moving to a closed position when said closure member is in said third position.

45. A pour spout, as claimed in claim 44, wherein said push rod is interconnected with said conduit member, and wherein said one-way valve is interconnected with said closure member.

46. A pour spout for conducting fluid from a container to a receptacle, said pour spout comprising:

a conduit member including a first end interconnectable with the container and a second end having a discharge opening and a vent opening;

a closure member positioned adjacent to said discharge opening, said closure member being movable relative to said conduit member between a first position where said discharge and vent openings are closed, a second position where said vent opening is open, and a third position where said discharge opening is open; and a biasing member that biases said closure member from said third position toward said first position.

47. A pour spout, as claimed in claim 46, wherein said biasing member comprises a coil spring.

48. A pour spout for conducting fluid from a container to a receptacle, said pour spout comprising:

a conduit member including a first end interconnectable with the container and a second end having a discharge opening and a vent opening;

a closure member positioned adjacent to said discharge opening, said closure member being movable relative to said conduit member between a first position where said discharge and vent openings are closed, a second position where said vent opening is open, and a third position where said discharge opening is open; and a biasing member that biases said closure member from said second position toward said first position.

49. A pour spout, as claimed in claim 48, further comprising a latch member that retains said closure member in said second position.

50. A pour spout, as claimed in claim 49, wherein said latch member comprises a flexible member mounted to said conduit member, said flexible member being positioned to selectively engage a detail on said closure member.

51. A pour spout, as claimed in claim 49, wherein said biasing member further biases said closure member from said third position to said first position, and wherein movement of said closure member from said third position to said first position is free from retainment by said latch member.

52. A pour spout for conducting fluid from a container to a receptacle, said pour spout comprising:

a conduit member including a first end interconnectable with the container and a second end having a discharge opening and a vent opening; and a closure member positioned adjacent to said discharge opening, said closure member being movable relative to said conduit member between a first position where said discharge and vent openings are closed, a second position where said vent opening is open, and a third position where said discharge opening is fully open, wherein a portion of said closure member is between said vent opening and said first end of said conduit member when said closure member is in said third position.

53. A pour spout for conducting fluid from a container to a receptacle, said pour spout comprising:

a conduit member including a first end interconnectable with the container and a second end having a discharge opening and a vent opening; and a closure member positioned substantially completely around an exterior of said conduit member and adjacent to said discharge opening, said closure member being movable relative to said conduit member between a first position where said discharge and vent openings are closed, a second position where said discharge opening is closed and said vent opening is open, and a third position where said discharge opening is open.

* * * * *